US010878784B2

(12) United States Patent
Mulvey

(10) Patent No.: US 10,878,784 B2
(45) Date of Patent: Dec. 29, 2020

(54) GUITAR NECK JOINT

(71) Applicant: Jonathan Mulvey, Prunedale, CA (US)

(72) Inventor: Jonathan Mulvey, Prunedale, CA (US)

( * ) Notice: Subject to any disclaimer, the term of this patent is extended or adjusted under 35 U.S.C. 154(b) by 0 days.

(21) Appl. No.: 16/386,208

(22) Filed: Apr. 16, 2019

(65) Prior Publication Data

US 2020/0335069 A1 Oct. 22, 2020

(51) Int. Cl.
*G10D 3/06* (2020.01)
*G10D 1/08* (2006.01)

(52) U.S. Cl.
CPC ..... *G10D 3/06* (2013.01); *G10D 1/085* (2013.01)

(58) Field of Classification Search
CPC ..... G10D 3/06; G10D 1/085
See application file for complete search history.

(56) References Cited

U.S. PATENT DOCUMENTS 5,305,819 A * 4/1994 Boulanger ..... G10D 3/06 144/347
10,311,838 B2 * 6/2019 Mulvey ..... G10D 1/085

* cited by examiner

*Primary Examiner* — Kimberly R Lockett
(74) *Attorney, Agent, or Firm* — Larisa Migachyov

(57) ABSTRACT

A neck joint for an electric guitar, comprising an elongated protrusion with rounded corners fitting into a similar-shaped pocket with similarly rounded corners, which creates a strong enough connection between the neck and the body that the neck no longer requires a heel, improving the range of the guitar and the sound of the instrument.

7 Claims, 4 Drawing Sheets

GUITAR NECK JOINT

CROSS-REFERENCE TO RELATED APPLICATIONS

This application is a continuation of application Ser. No. 15/810,686, filed Nov. 13, 2017, which takes priority from Provisional App. No. 62/420,561, filed Nov. 11, 2016, which are herein incorporated by reference.

BACKGROUND

A guitar is typically composed of a neck and a body. The strings are attached to the end of the neck on one end and to the body of the guitar on the other end. Since guitar strings are under continued tension, they place very high forces on the joint between the neck and the body, especially since the neck acts as a long lever.

Some guitar designs attach the neck joint by glue (i.e. the Gibson set neck design), and some attach it by bolts. In either case, to prevent the neck from moving or breaking under the tension of the strings, the neck typically comprises a heel at the joint between the body and the neck. The heel is a protrusion that extends throughout the thickness of the guitar body and provides structural support for the neck joint to ensure stability. Since guitar strings are under continued tension, it is important to connect the neck to the body in a way that will support the tension of the strings and prevent the neck from moving.

Unfortunately, while a heel is very good at providing structural stability to the neck joint, it also takes up space. In particular, the heel can block a guitar player's hand when the player tries to reach very high notes on the instrument, since those high notes are located at the neck joint. The neck is typically 21-24 frets in length; to ensure structural stability, the heel has to start at approximately the $15^{th}$ fret. That makes the higher frets hard to access.

Also, a traditional square neck joint only bears tension on the bottom side, which is not efficient and does not provide as much strength. Also, since the sides of the traditional square neck joint do not bear any tension, they do not contact the body and do not contribute to the resonance.

Some guitar designs solve this problem by making a neck run the entire length of the guitar; however, this design is more difficult to manufacture and not as aesthetically pleasing.

A need exists for a bolt-on guitar design that does not require a heel and that provides a strong and resonant connection between the neck and the body.

SUMMARY OF THE INVENTION

An object of the present invention is to provide a guitar design where the neck joint enables a user to reach further into the fingerboard than conventional designs.

Another object of the present invention is to provide a guitar design where the neck joint does not require a heel.

The guitar of the present invention comprises a neck and a guitar body; the neck is connected to the guitar body at the neck joint. The neck joint comprises an elongated protrusion located approximately along the centerline of the neck, where the height of the protrusion is less than the thickness of the guitar body. The neck joint and the elongated protrusion thereon fit into a pocket on the guitar body that is shaped the same as the neck joint so that the neck joint fits into the pocket.

In an embodiment, the neck joint, the protrusion, or both the neck joint and the protrusion comprise rounded corners.

LIST OF FIGURES

DETAILED DESCRIPTION OF THE PREFERRED EMBODIMENT

A preferred embodiment of the present invention is described in the below disclosure. It will be understood that reasonable equivalents to each element of the invention will be apparent to a person of reasonable skill in the art, and that the present invention is only limited by the appended claims.

Figure 1:
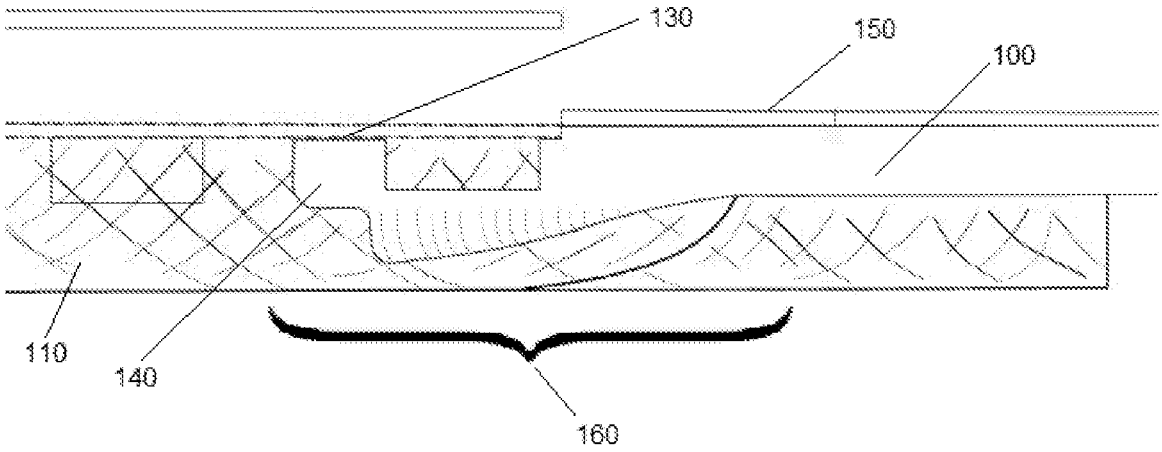
FIG. 1 shows a cross-sectional view of the guitar of the present invention.

FIG. 1 shows a cross-sectional view of the guitar of the present invention. As can be seen, there is no heel, which enables a user to reach higher notes on the guitar neck. The neck 100 is attached to the guitar body 110 by three bolts as shown; the area of the neck where the neck 100 is in contact with the guitar body 110 is the neck joint 160. Fretboard 150 is located on the top of the neck 100 the way that it is on any standard guitar. The neck joint has a rounded shape as shown, with no vertical surfaces either on the neck or on the guitar body. Since the rounded shape of the neck joint has no vertical surfaces, the entire area where the neck is attached to the guitar body is one in which the neck exerts a force on the guitar body, since the bolts apply a force that is vertical. This prevents gaps between the neck and the body and enables better resonance, as well as a more secure attachment between the neck and the body that does not wobble or move, even despite the high forces placed on the neck by the tension of guitar strings.

In an embodiment, the neck joint comprises a protrusion that fits into a corresponding pocket on the guitar body. The shape of the protrusion may be any shape and may assist in creating a more secure attachment between the neck and the body.

In addition, since the neck joint and the protrusion are rounded, this allows a greater surface area of the neck joint to be in tension-bearing contact with the body. The tension creates more resonance and improves the sound of the instrument.

An additional feature of the present invention is pick guard 130, which is countersunk into the body of the guitar in a way that ensures that it is in contact with the neck 100 at the neck tenon 140. This allows it to resonate and improves the sound of the instrument.

Figure 2:
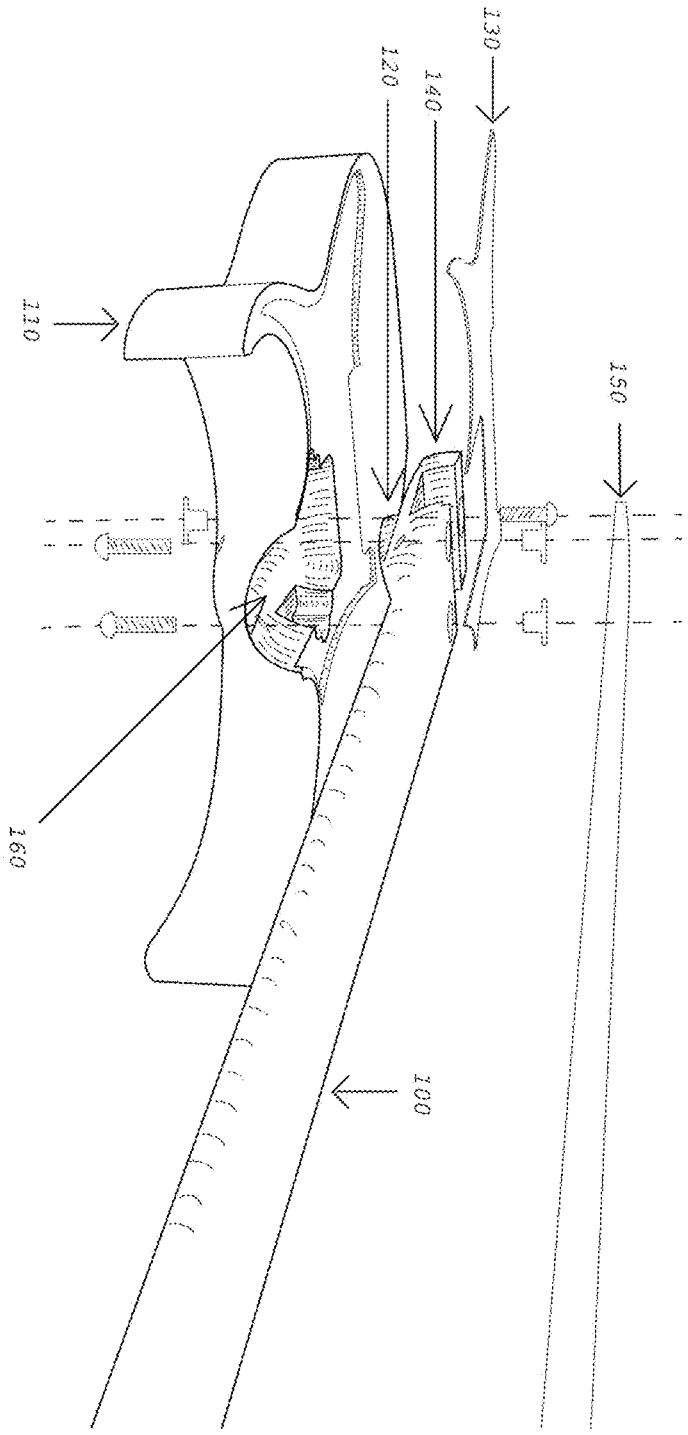
FIG. 2 shows an exploded view of the guitar of the present invention.

An exploded view of the same guitar design is shown as FIG. 2. It shows a closer view of the pocket 160 on the guitar body. As can be seen from the Figure, the pocket 160 is the same shape as the neck joint, to ensure a close fit between the neck and the body.

Figure 3:
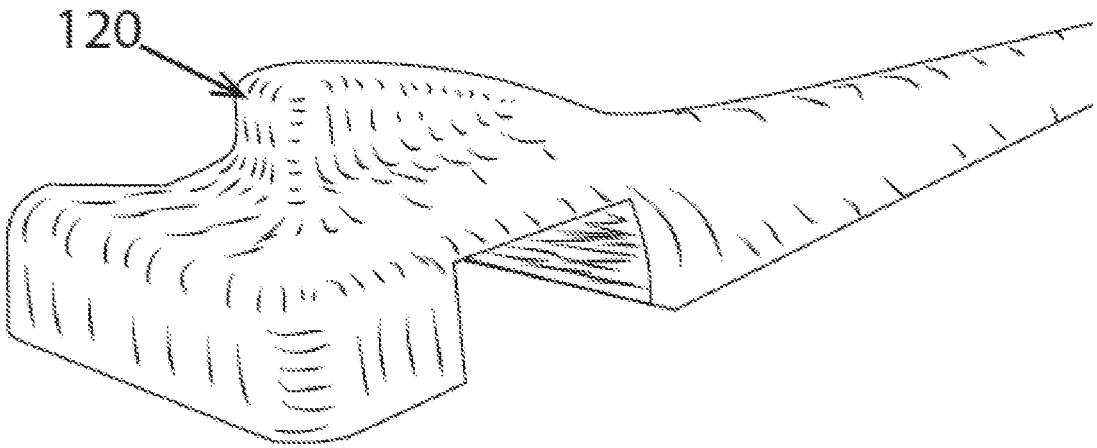
FIG. 3 shows a view of the neck joint of the guitar of the present invention.

FIG. 3 shows an embodiment of the neck joint of the present invention, showing the protrusion 120 in greater detail. While the protrusion may be any shape, it is most preferable for it to be elongated in the direction of the length of the neck (i.e. longer than it is wide) and to have a height of at least 0.6" and a width that is smaller than the width of the neck. Having this shape ensures a secure connection between the protrusion and the corresponding pocket in the body of the guitar and prevents sideways motion of the guitar neck.

The protrusion may be of any length, but is preferably approximately 2". In the preferred embodiment shown in FIG. 3, the length of the protrusion, as shown, is 2.12" and the height of the protrusion is 0.6097". The width of the protrusion is preferably somewhat smaller than the width of the neck, as shown, and is preferably about ¼ the width of the neck.

In the preferred embodiment, all the corners of the neck joint are rounded, as shown in FIG. 3. This ensures a better fit between the surfaces of the neck and the body and prevents wobbling. The radius of the corners is preferably 0.25" in the preferred embodiment.

In an embodiment, as shown in FIG. 3, the protrusion 120 is variable in height, and higher where it is closer to the end of the neck. While this is not required for practicing the present invention, this improves the neck joint's ability to withstand the force of the strings.

Figure 4:
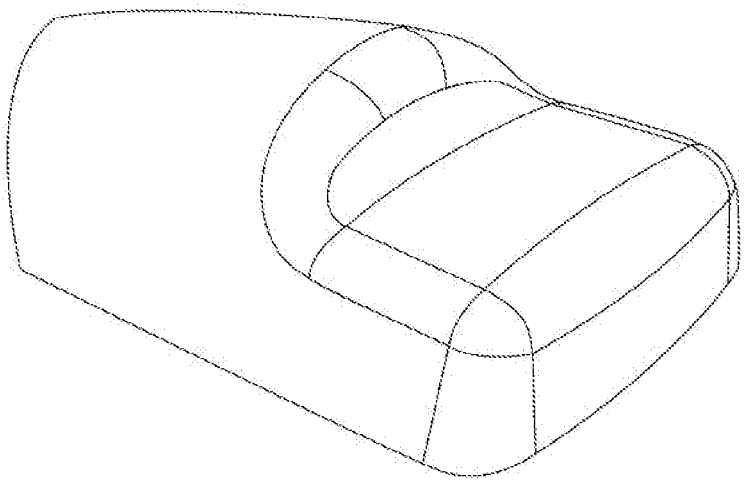
FIG. 4 shows a view of an embodiment of the neck joint of the guitar of the present invention.

FIG. 4 shows an alternate design of the neck joint that does not include a protrusion. As can be seen, the neck joint is rounded so that there are no vertical surfaces and no gaps between the neck and the body of the guitar. The flat surface 400 at the end of the neck is preferably at a 70 degree angle to the fingerboard, but may be at any other angle that is not 90 degrees, to prevent gaps from forming between the neck and the body.

Since the protrusion and the general rounded shape of the neck joint of the present invention provide a highly secure connection between the neck and the body of the guitar, a heel is not required; this improves the player's reach of the high notes on the guitar. The bolt connection between the neck and the body, combined with the protrusion and the neck joint fitting into a corresponding pocket in the body of the guitar, creates enough strength to withstand the force that guitar strings would apply.

The neck joint can include a neck pickup cutout as shown in FIG. 3. This enables the neck pickup to be located in the middle of the guitar.

An exemplary embodiment is described above. It will be understood that the present invention encompasses other embodiments that are reasonable equivalents to the above-described embodiments, and that the invention is only limited by the appended claims.

The invention claimed is:

1. An electric guitar, comprising:

a neck, wherein the neck comprises a fingerboard on a first side, wherein the neck comprises a neck joint which attaches to a guitar body on a second side opposite the first side;

a guitar body, wherein the guitar body comprises a pocket for connecting to the neck joint;

wherein the neck joint comprises a rounded surface with no vertical surfaces, wherein vertical surfaces are defined as surfaces perpendicular to the fingerboard, and no sharp corners;

wherein the pocket comprises a surface that matches the neck joint with no gaps when the neck joint is placed in the pocket.

2. The electric guitar of claim 1, further comprising:

a pick guard, said pick guard located in such a way as to touch the neck joint, wherein the pick guard is rigidly attached to the neck joint.

3. The electric guitar of claim 1, wherein the rounded surface of the neck joint does not comprise a protrusion.

4. The electric guitar of claim 1, wherein the rounded surface comprises at least one flat side immediately adjacent to the fingerboard, wherein an angle between at least one flat side and the fingerboard is approximately 70 degrees.

5. The electric guitar of claim 1, wherein the neck further comprises:

a neck pickup cutout, the neck pickup cutout located on the first side of the neck, the cutout comprising a length and width that is sufficient to accommodate a neck pickup placed into the cutout.

6. The electric guitar of claim 1, wherein the neck joint is at least ⅓ and not exceeding ½ of a length of the guitar body.

7. The electric guitar of claim 1, wherein the neck joint comprises a first through hole, further comprising a first bolt that goes through the first through hole and attaches the neck joint to the guitar body, and wherein the guitar body comprises a second through hole and a third through hole in the area of the pocket, further comprising a second bolt and a third bolt that go through the second and third through holes, respectively, and attach the guitar body to the neck joint.

* * * * *